US008899583B2

(12) United States Patent
de Jong et al.

(10) Patent No.: US 8,899,583 B2
(45) Date of Patent: Dec. 2, 2014

(54) TRACKING IN BELT ON BELT ARCHITECTURE THROUGH SELF-ALIGNMENT

(71) Applicant: Xerox Corporation, Norwalk, CT (US)

(72) Inventors: Joannes N. M. de Jong, Hopewell Junction, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/840,506

(22) Filed: Mar. 15, 2013

(65) Prior Publication Data

US 2014/0265109 A1 Sep. 18, 2014

(51) Int. Cl.
*B65H 5/02* (2006.01)
*B65H 9/00* (2006.01)

(52) U.S. Cl.
CPC ..... *B65H 9/00* (2013.01)
USPC ..... 271/275; 198/626.3; 198/626.4

(58) Field of Classification Search
CPC ..... B65H 5/004; B65H 5/023; B41J 11/007; B41J 13/08; B65G 15/14; B65G 15/16
USPC ..... 271/3.21, 3.22, 4.06, 10.07, 273–275; 347/104; 399/66, 312, 313; 198/626.3–626.6
See application file for complete search history.

(56) References Cited

U.S. PATENT DOCUMENTS

| | | | | |
|---|---|---|---|---|
| 5,145,123 | A * | 9/1992 | Kotikovsky | 242/384.5 |
| 6,092,891 | A * | 7/2000 | Okubo et al. | 347/104 |
| 7,703,769 | B2 * | 4/2010 | Schwarzbauer | 271/275 |
| 2006/0104678 | A1 * | 5/2006 | Kuo et al. | 399/313 |
| 2011/0203902 | A1 * | 8/2011 | Sakuyama | 198/339.1 |
| 2014/0078232 | A1 * | 3/2014 | Kondo et al. | 347/104 |

* cited by examiner

*Primary Examiner* — Jeremy R Severson
(74) *Attorney, Agent, or Firm* — Hoffmann & Baron, LLP

(57) ABSTRACT

Provided herein is a document processing system with improved paper path alignment and superior media hold-down capability, which minimizes undesirable electrostatic fields in the print zone. The document processing system includes a first belt module including a first roller and a second roller with a tack belt in surrounding engagement with the first roller and the second roller. The processing system further includes a second belt module, which includes a third roller and a fourth roller with a media transport belt in surrounding engagement with the third roller and the fourth roller. A mounting support for the first belt module is also included herein, the mounting support is designed to allow the first module to self-align relative to the second transport.

12 Claims, 3 Drawing Sheets

TRACKING IN BELT ON BELT ARCHITECTURE THROUGH SELF-ALIGNMENT

BACKGROUND

1. Technical Field

The presently disclosed technologies are directed to a system and method for improving paper path alignment by preventing contention between two belt transports in a direct marking hold-down transport system. The system and method described herein use a mounting bracket which allows for self-alignment of one transport relative to the other.

2. Brief Discussion of Related Art

In order to ensure good print quality in direct to paper ("DTP") ink jet printing systems, the media substrate must be held extremely flat in the print zone. Conventional approaches use electrostatic tacking of media to a moving transport belt that is held flat against a platen in an imaging zone or printing zone. Conventional electrostatic tacking methods create a tacking field by primarily applying charges to a media substrate side that is not in contact with the tacking surface (transport belt). The charges can be applied by well-known methods in the art including the use of various non-contact corona charging devices or the use of various pressured devices, such as a biased roller. Generally, pressured devices such as bias rollers are preferred because the presence of mechanical pressure helps to tack stressful media such as curled or cockled media substrates. An undesirable side effect of electrostatic tacking of media substrates is the creation of a high electric field between the surface of the media substrate and the imaging heads (also referred to herein as print heads). As the media substrate travels in the printing zone, the high electrostatic field can affect the ink jetting, which results in print quality defects.

An additional drawback to the use of electrostatic tacking forces is that when multiple belt modules and tacking belts are used in a printing system, the electrostatic forces applied to each belt and/or module are quite large and if the multiple belt systems are not perfectly aligned this can result in large lateral forces at the intersection of the belts. This results in misalignment of the belts and can cause problems in printing or copying systems.

In order to solve this problem, a dual belt system designed to maximize hold-down while minimizing undesirable fields in the print zone is described in patent application Ser. No. 13/669,578, which applies electrostatic charges to the side of media that faces the belt transport while still maintaining high tack force. One concern with this approach is that large lateral belt forces can be seen if the two belt systems are not perfectly aligned.

Despite these efforts, misalignment may still be a problem. The media substrate, when tacked by electrostatic tacking methods, almost always produces an electric field. Accordingly, it is desirable to reduce the undesired effects of the electrostatic forces, and further preventing and/or correcting any misalignment of the media substrate processing path which may result as a result of the electrostatic forces.

SUMMARY

Provided herein therefore, is a document processing system with improved paper path alignment and superior media hold-down capability, while minimizing undesirable electrostatic fields in the print zone. The document processing system includes a first belt module including a first roller and a second roller with a tack belt in surrounding engagement with the first roller and the second roller. The processing system further includes a second belt module, which includes a third roller and a fourth roller with a media transport belt in surrounding engagement with the third roller and the fourth roller. In the present invention a mounting support for the first belt module is also provided, the mounting support is designed to allow the first belt module to self-align relative to the second transport.

One exemplary embodiment uses a spherical bearing attached to a bracket which supportingly engages the first belt module. The mounting support allows the first belt module to rotate and self-align relative to said second belt module. This is due to caster type forces wherein any lateral forces due to misalignment or slip result in a moment which tends to rotate the first transport into alignment with the second belt transport. The mounting support/system includes three degrees of freedom such that the first transport can rotate around all three axes. This ensures a uniform load along the line of contact with the second transport and enables the first transport to self-align in the transport direction as described above.

In another embodiment, the first belt module and the second belt module of the document processing system are configured to minimize a net charge on a media substrate and thereby minimize electric field effects in a print zone as the media substrate passes under printheads. In another embodiment, the mounting support of the document processing system allows a biasing force acting on the first belt module to ensure alignment of said first belt module and said second belt module, wherein said biasing force is selected from the group of gravity or a spring mechanism.

In an embodiment, the downstream end of the first belt module meets an upstream end of said second belt module. In another embodiment, the mounting support has a range of motion on three axes, resulting in a castering force acting on said first belt module thereby exerting a movement which moves said first transport into alignment with said second transport.

In another embodiment, the media transport belt is tracked using a belt edge sensor and an actively controlled steering roll. In yet another embodiment, at least one of the tacking belt and the media transport belt are tracked using a passive tracking system. In another embodiment, the first belt module is tracked using a passive tracking system.

In another embodiment, a media substrate traveling through the document processing system has a resulting net charge that minimizes interactions with jetted ink in a printing zone. In another embodiment, the document processing system further includes a pressure blade, which facilitates tacking of a media substrate.

In another embodiment, the present invention includes a mounting support for a belt module in a printer. The mounting support includes a spherical bearing attached to a bracket which supportingly engages the belt module, the mounting support allowing rotation on three axes for said belt module in order to allow said belt module to ensure proper paper path alignment.

BRIEF DESCRIPTIONS OF THE DRAWINGS

DETAILED DESCRIPTION

Describing now in further detail these exemplary embodiments with reference to the Figures.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "media substrate" refers to, for example, paper, transparencies, parchment, film, fabric, plastic, or other substrates on which information can be reproduced, for example, in the form of a sheet or web.

A "nip" refers to a location in a document processing device at which a sheet is propelled in a process direction. A nip may be formed between an idler wheel and a drive wheel.

Provided herein is an improved paper path system and mounting support in a document processing system. The mounting support supportingly engages a belt module so that the belt module is allowed to move along three axes of rotation, or has three degrees of freedom in its movement. This allows the belt module to effectively counteract electrostatic forces which may bias it away from a mated belt module, and ensure proper paper path alignment.

It is recognized that three degrees of freedom of rotation, or the ability to move along three axes of rotation, both refer to movements in a three-dimensional Cartesian coordinate system. A Cartesian coordinate system for a three-dimensional space refers to an ordered triplet of lines (e.g., x, y, and z), any two of them being perpendicular, where each axis is oriented perpendicularly to the other. In the document processing system, for example, movement of the belt module through the novel mounting support may be in three axes around support 45, illustrated more clearly in the detailed description below. There are three axes of rotation x, y, z, around the support 45. This allows roll 49 to move in y (lateral), z and rotate around x.

In order to provide proper paper path alignment, one attempt to solve the problem can be seen in U.S. patent application Ser. No. 13/669,578, (herein incorporated by reference) which includes a dual belt system designed to maximize hold-down while minimizing undesirable fields in the print zone by applying electrostatic charges to the side of media that faces the belt transport while still maintaining high tack force. The invention disclosed in Ser. No. 13/669,578 may be used independently or complementary with the invention described herein.

Figure 1:
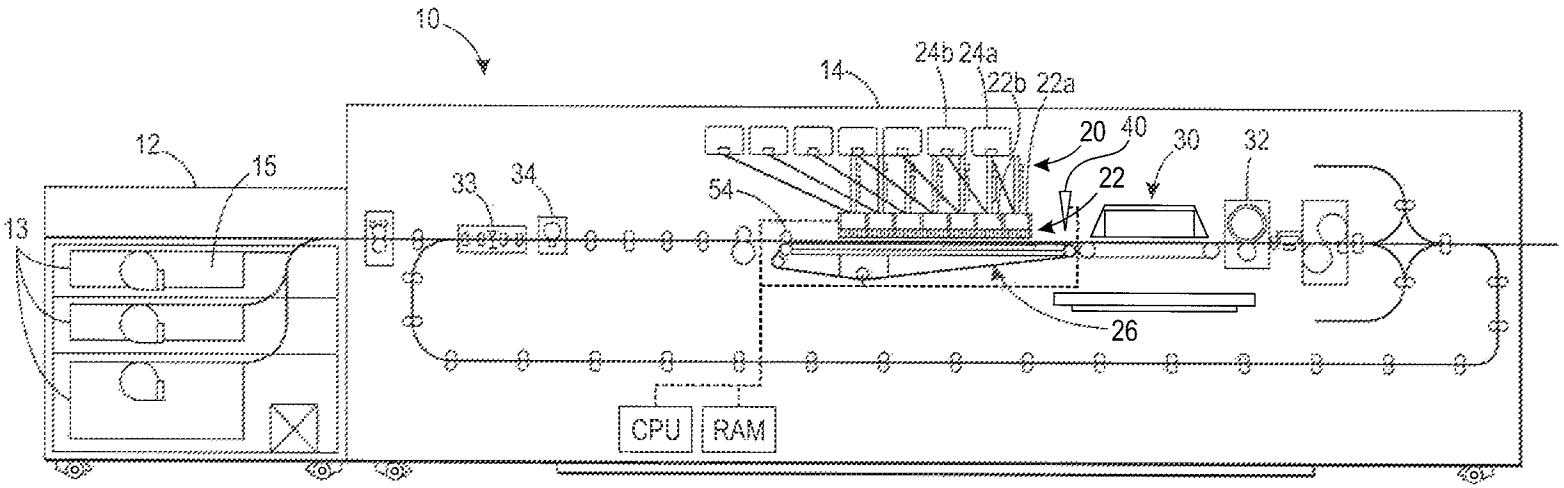
FIG. 1 shows an example of a document processing system in which the present invention may be employed.

With reference to FIG. 1, an example of a document processing system and apparatus 10 in which the present invention can be employed, is shown. A media substrate is transported onto the hold-down print zone transport 26 using a traditional nip based registration transport with nip releases. As soon as the lead edge of the media substrate is acquired by the hold-down transport in the media acquisition area 54, the registration nips are released. Media acquisition by the print zone transport 26 can be performed via a vacuum belt transport. One or more inks 24 or the like are applied to a media substrate, and a printed media is transported to an ultraviolet cure zone 30.

Figure 2:
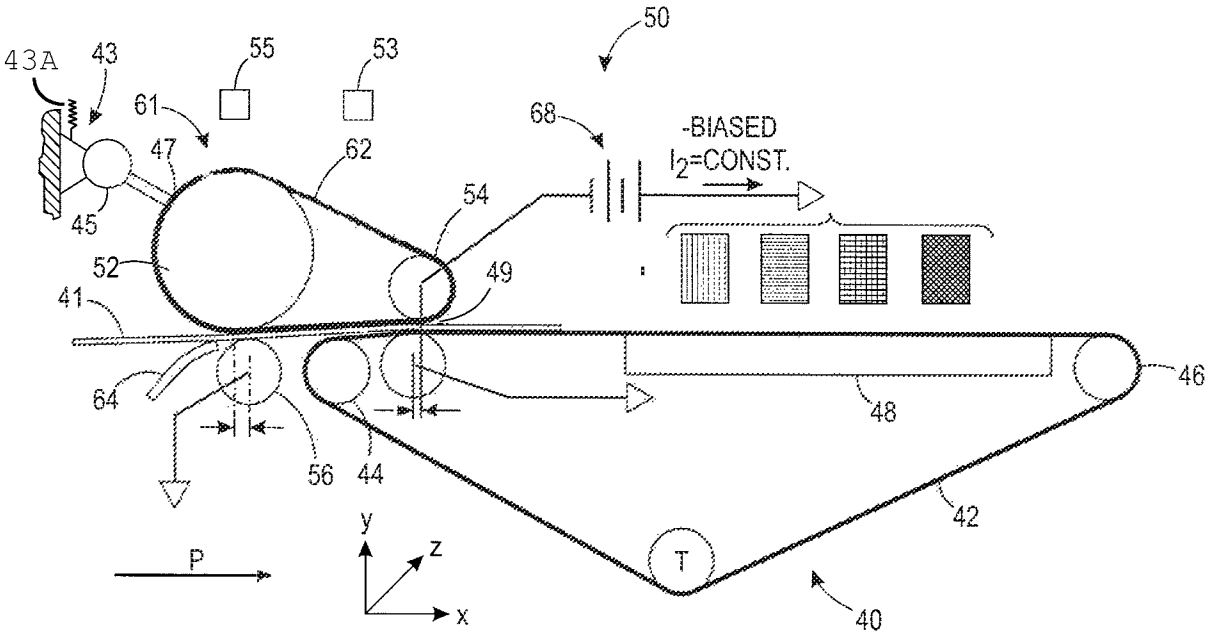
FIG. 2 shows a print zone transport area including the inventive features of the present invention.

With reference to FIG. 2 of the drawings, a printing system 50 is shown, having a first belt module 61. First belt module 61 includes a first roller 52 and second roller 54, with tacking belt 62 wrapped around them. Optionally a first charging device, such as a bias transfer roll 56 is also present. Tacking belt 62 can be an insulator, semiconductor, or some other suitable material. A media substrate 41 is fed into an upstream nip between first roller 52 and bias transfer roll 56. The upstream nip together with a pressure blade 64 facilitates tacking media to tack belt 62.

Printing system 50 may also further include a belt edge sensor 53 and a passive tracking system shown as 55. Each of these are well known in the art and any compatible sensors or tracking systems may be used. Each of the rollers may be an active, or drive roller; or an idle roller. Each of the idler rollers may have an outer surface including a noncompliant material, such as hard plastic. Each of the drive rollers may include an outer surface having a compliant material such as rubber, neoprene or the like. The compliant material helps to grip the sheet and permit the drive roll to move the sheet through the nip. Each of the drive rollers rotates about a drive shaft and may be directly driven by a drive motor (not shown), such as a stepper motor, a DC motor or the like. A transmission device (also not shown) may extend between the drive motor and the drive roll for imparting motion to the drive roll. The transmission device may include a timing belt, gear trains or other transmission means known to those of ordinary skill in the art.

A second belt module 40 is shown including third roller 51 and fourth roller 46, with media transport belt 42 in surrounding engagement with the rollers. Also optionally present is steering roll 44 utilized for belt guidance. Third roller 51 and second roller 54 may form a nip through which media substrate 41 is propelled into print zone 50. A mounting support 43 is shown including a spherical bearing 45 and a belt module frame 47 which supportingly engages belt first belt module 61. Spherical bearing 45 and belt module frame 47 allow first belt module 61 to move and adjust along three rotational axes x, y, and z to counteract any forces which could cause paper path misalignment; i.e., such as but not limited to electrostatic forces which repel first belt module 61 and second belt module 40 away from each other, or disrupt the paper path feed from first belt module 61 to second belt module 40.

Mounting support 43 further allows a biasing force which acts on first belt module 61 to ensure first belt module 61 and second belt module 40 maintain proper path alignment by allowing the biasing force to keep the modules together. The biasing force includes, but is not limited to, gravity, or some type of spring mechanism (43A) commonly known in the art. As shown in the drawings the downstream end of first belt module 61 meets an upstream end of second belt module 40 at juncture 49. Juncture 49 may be an area of conflicting electrostatic forces because each of tacking belt 62 and media processing belt 42 often have conflicting charges in their efforts to hold down media substrate 41.

Media substrate 41 is transported through printing zone 50 along direction P, which is parallelly oriented to an x axis. Mounting support 43 allows first belt module to move in any direction or spatial orientation in planes represented by axes represented by rotational x, y, and z around support 45 in order to ensure paper path alignment.

Figure 3:
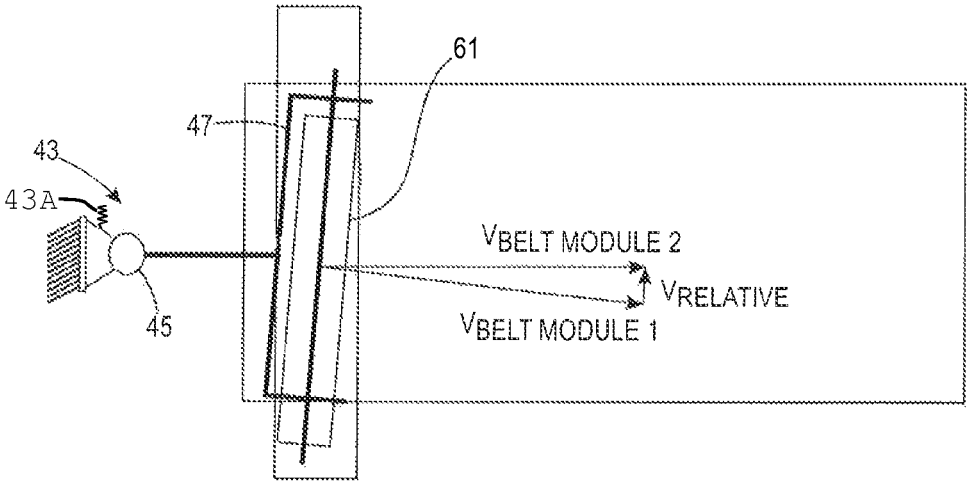
FIG. 3 shows a top view of a mounting support of the present invention.

With reference now to FIG. 3 of the drawings, a close-up view of mounting support 43 is shown. Spherical bearing 45 is shown, attached to belt module frame 47, which supports first belt module 61. Any misalignment between second belt module and first belt module 61 results in a relative velocity and force that yields a moment around spherical bearing 45 pivot causing rotation and thus lateral (y-direction) movement of the first belt module. Once the modules are aligned, slip differential equals zero, the moment vanishes and the relative force between the modules goes away enabling relatively simple and accurate belt tracking.

Figure 4:
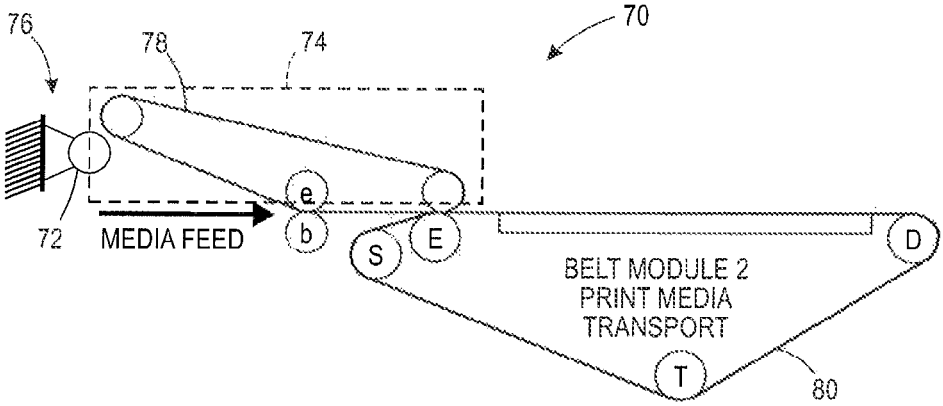
FIG. 4 shows another view of a mounting support of the present invention.

With reference now to FIG. 4 of the drawings, another printing system 70 of the present invention is shown. Printing system includes spherical bearing 72 and belt module frame 74 which comprise a mounting support 76 of the present invention. Mounting support 76 supportingly engages a first belt module 78, and printing system 70 further includes second belt module 80.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A document processing system with improved paper path alignment comprising:

a first belt module comprising a first roller and a second roller with a tack belt in surrounding engagement with said first roller and said second roller;

a second belt module comprising a third roller and a fourth roller with a media transport belt in surrounding engagement with said third roller and said fourth roller;

a mounting support for said first belt module which supportingly engages said first belt module, wherein said mounting support allows movement along three axes to allow said first belt module to align with second belt module.

2. The document processing system according to claim 1 wherein said first belt module and said second belt module are configured to minimize a net charge on a media substrate, and thereby minimize electric field effects in a print zone.

3. The document processing system according to claim 1 wherein said mounting support for said first belt module includes a spherical bearing.

4. The document processing system according to claim 3 wherein a downstream end of said first belt module meets an upstream end of said second module.

5. The document processing system according to claim 3 wherein said mounting support further comprises a castering force acting on said first belt module.

6. The document processing system according to claim 1 wherein said mounting support allows a biasing force acting on said first belt module to ensure alignment of said first belt module and said second belt module, wherein said biasing force is selected from the group of gravity or a spring mechanism.

7. The document processing system according to claim 1 wherein said media transport belt is tracked using a belt edge sensor and an actively controlled steering roll.

8. The document processing system according to claim 1 wherein at least one of said tacking belt and said media transport belt are tracked using a passive tracking system.

9. The document processing system according to claim 8 wherein said first belt module is tracked using a passive tracking system.

10. The document processing system according to claim 1 wherein a media substrate traveling through said system has a resulting net charge that minimizes interactions with jetted ink in a printing zone.

11. The document processing system according to claim 1 further comprising a pressure blade.

12. A mounting support for a belt module in a printer comprising:

a belt module comprising, at least, a first roller and a second roller;

a mounting support; and a spherical bearing attached to a bracket which supportingly engages said belt module, said mounting support allows three degrees of rotational freedom for said belt module in order to allow said belt module to ensure proper paper path alignment.

* * * * *